US007255040B2

(12) United States Patent
Sjoberg

(10) Patent No.: US 7,255,040 B2
(45) Date of Patent: Aug. 14, 2007

(54) PROCESS FOR THE MANUFACTURING OF PANELS HAVING A DECORATIVE SURFACE

(75) Inventor: Ake Sjoberg, Lund (SE)

(73) Assignee: Pergo (Europe) AB, Trelleborg (SE)

( * ) Notice: Subject to any disclaimer, the term of this patent is extended or adjusted under 35 U.S.C. 154(b) by 166 days.

(21) Appl. No.: 11/008,182

(22) Filed: Dec. 10, 2004

(65) Prior Publication Data

US 2005/0144898 A1 Jul. 7, 2005

(30) Foreign Application Priority Data

Dec. 11, 2003 (SE) ..... 0303329

(51) Int. Cl.
*B41D 7/00* (2006.01)
*D06N 3/00* (2006.01)

(52) U.S. Cl. ..... 101/33; 101/128.21; 101/483; 101/485; 428/151

(58) Field of Classification Search ..... 101/33, 101/128.21; 428/57–62, 142, 144, 151–160, 428/163, 166, 172, 187, 292.4, 479.6, 540, 428/542.6
See application file for complete search history.

(56) References Cited

U.S. PATENT DOCUMENTS

| | | | | |
|---|---|---|---|---|
| 2,108,226 | A | | 2/1938 | Johnston |
| 3,373,068 | A | | 3/1968 | Grosheim et al. |
| 3,672,926 | A | * | 6/1972 | Ramey ..... 427/267 |
| 3,811,915 | A | | 5/1974 | Burrell et al. |
| 3,814,647 | A | | 6/1974 | Scher et al. |
| 3,878,030 | A | | 4/1975 | Cook |
| 4,233,343 | A | | 11/1980 | Barker et al. |
| 4,284,453 | A | | 8/1981 | Endrizzi |
| 4,290,248 | A | | 9/1981 | Kemerer et al. |
| 4,367,110 | A | | 1/1983 | Yoshikawa |
| 4,376,812 | A | | 3/1983 | West |
| 4,396,448 | A | | 8/1983 | Ohta et al. |
| 4,448,849 | A | | 5/1984 | Keeling et al. |
| 4,501,635 | A | | 2/1985 | Siry et al. |

(Continued)

FOREIGN PATENT DOCUMENTS

| | | |
|---|---|---|
| DE | 19845496 | 4/2000 |

(Continued)

OTHER PUBLICATIONS

Co-pending U.S. Appl. No. 09/718,401, filed Nov. 24, 2000.

*Primary Examiner*—Daniel J. Colilla
*Assistant Examiner*—N. Ha
(74) *Attorney, Agent, or Firm*—Steven Davis Miller & Mosher LLP

(57) ABSTRACT

A process for the manufacturing of panels having a decorative surface whereby the decor of the panels is achieved by means of printing a plurality of different decor sections ($\mathbf{1}^n$) on a web (1). Each decor section ($\mathbf{1}^n$) being intended to constitute the decor of a panel. Each decor section ($\mathbf{1}^n$) having a beginning ($\mathbf{1}^B$) and an end ($\mathbf{1}^E$). At least the end ($\mathbf{1}^E$) of a first decor section ($\mathbf{1}^1$) is made to match the beginning ($\mathbf{1}^B$) of a second decor section ($\mathbf{1}^2$) so that when the first decor section ($\mathbf{1}^1$) and the second decor section ($\mathbf{1}^2$) is arranged in a row, the decor of the first decor section ($\mathbf{1}^1$) will give the impression of continuing on the second decor section ($\mathbf{1}^2$).

13 Claims, 2 Drawing Sheets

U.S. PATENT DOCUMENTS

| | | | | |
|---|---|---|---|---|
| 4,599,127 | A | 7/1986 | Cannady, Jr. et al. | |
| 4,689,102 | A | 8/1987 | Prawdzik et al. | |
| 4,864,790 | A | 9/1989 | Liardet | |
| 5,034,272 | A | 7/1991 | Lindgren et al. | |
| 5,226,273 | A | 7/1993 | Burke | |
| 5,314,554 | A | 5/1994 | Owens | |
| 5,413,834 | A | 5/1995 | Hunter et al. | |
| 5,624,471 | A | 4/1997 | Gaeta et al. | |
| 5,713,173 | A | 2/1998 | Von Langsdorff | |
| 5,723,221 | A | 3/1998 | Brooker et al. | |
| 5,736,227 | A | 4/1998 | Sweet et al. | |
| 5,744,220 | A | 4/1998 | Ringo | |
| 5,830,573 | A | 11/1998 | Lambert et al. | |
| 5,858,260 | A | 1/1999 | Daussan et al. | |
| 5,961,903 | A | 10/1999 | Eby et al. | |
| 6,106,654 | A | 8/2000 | Velin et al. | |
| 6,114,008 | A | 9/2000 | Eby et al. | |
| 6,132,883 | A | 10/2000 | McGrath et al. | |
| 6,203,879 | B1 * | 3/2001 | Desai | 428/88 |
| 6,401,415 | B1 | 6/2002 | Garcia | |
| 6,517,935 | B1 | 2/2003 | Kornfalt et al. | |
| 6,565,919 | B1 | 5/2003 | Hansson et al. | |
| 6,638,387 | B2 | 10/2003 | Cruz | |
| 6,645,046 | B1 | 11/2003 | Vogtmann et al. | |
| 6,685,993 | B1 | 2/2004 | Hansson | |
| 6,888,147 | B1 | 5/2005 | Hansson | |
| 6,991,830 | B1 | 1/2006 | Hansson | |
| 7,003,364 | B1 | 2/2006 | Hansson | |
| 2002/0160680 | A1 | 10/2002 | Laurence et al. | |
| 2003/0108717 | A1 * | 6/2003 | Sjoberg | |
| 2003/0207083 | A1 | 11/2003 | Hansson et al. | |
| 2005/0281993 | A1 | 12/2005 | Hansson et al. | |

FOREIGN PATENT DOCUMENTS

| | | | |
|---|---|---|---|
| EP | 0106707 | | 4/1984 |
| EP | 0883487 | | 12/1998 |
| EP | 0888215 | | 1/1999 |
| EP | 1153736 | | 11/2001 |
| EP | 1225033 | | 5/2004 |
| ES | 460194 | | 5/1978 |
| GB | 1472629 | | 5/1977 |
| GB | 2088280 | | 6/1982 |
| GB | 2324982 | | 11/1998 |
| JP | 4945565 | | 12/1975 |
| JP | 522642 | | 1/1977 |
| JP | 56101817 | | 8/1981 |
| JP | 7003504 | B | 1/1982 |
| JP | 59155087 | | 1/1985 |
| JP | 61291075 | | 12/1986 |
| JP | 5210355 | | 1/1988 |
| JP | 63062577 | | 3/1988 |
| JP | 1032789 | B | 7/1989 |
| JP | 4126571 | | 4/1992 |
| JP | 5188617 | | 7/1993 |
| JP | 06008392 | | 1/1994 |
| JP | 10330647 | | 12/1998 |
| SE | 512210 | | 2/2000 |
| WO | 9106728 | | 5/1991 |
| WO | 9301378 | | 1/1993 |
| WO | 9731776 | | 9/1997 |

* cited by examiner

PROCESS FOR THE MANUFACTURING OF PANELS HAVING A DECORATIVE SURFACE

BACKGROUND OF THE INVENTION

1. Field of the Invention

The present invention relates to the process for manufacturing a set of decorative panels provided with a decor which is matching over two opposite edges of the panels when the panels are arranged in a predetermined order.

2. Description of Related Prior Art

Panels coated with thermosetting laminates have been present on the market for some time now. They are foremost used where the demand for abrasion resistance is high, but also where resistance towards different chemicals and moisture is required. As an example of such products floors, floor beadings, table tops, work tops and wall panels can be mentioned.

The thermosetting laminate mostly consists of a base layer with a decor sheet placed closest to the surface. The decor sheet can be provided with a desired decor or pattern. The most frequent patterns usually represent the image of different kinds of wood, or minerals such as marble or granite. The surface of the laminate can be provided with a structure during the laminating procedure which will make the decor more realistic. Press plates with structure or structure foils are frequently used when manufacturing such a laminate. A negative reproduction of the structure in the press plate or the foil will be imprinted into the laminate during the laminating procedure.

One panel format which is rather common on the market is approximately 1.2×0.2 m. This format, and formats close to this, have the advantage that a package of a number of such panels is easy to handle and will be possible to transport in most cars. The format is still large enough to reduce the time used for installation of the panels. Formats much larger would be difficult to transport and formats much smaller would consume more time during installation.

As said earlier, the decor of these panels most often depicts products like wood and minerals. The wood decor may for example be constituted by a number of wood blocks arranged in parallel rows on each panel. Popular designs show two and three parallel rows of such blocks on each panel. It is important to design the decor so that the panels will give a continuous impression when installed. The design of parallel row wood block pattern can be designed as shown in WO 9301378 and the result on an installed floor will make the short side edges more or less disappear.

The decor of these panels are most often printed on a continuous web by means of one or more printing cylinders. It is understood that these printing cylinders have a repetition frequency which is depending on the diameter, or actually the circumference of the cylinder. The cost of such a cylinder is of course depending on the size i.e. diameter of the cylinder. A longer repetition distance will also add problems with format change of the decor. The format of the decor is caused by the different treatments the decor web is subjected to such as the printing itself, changes in moisture and temperature, impregnation, curing and the laminating process.

Another popular decor is when each panel depicts a wood plank or in other words that the panel has a decor which gives the impression that it is a single piece of solid wood. This makes it different from the blocked wood design described above. Here the length of 1.2 meter or so, seems a bit short and it would be more pleasing to the eye to have a panel length of 2 meters or more. However, this would give other problems like the transportability, the printing cost and the decor matching discussed above.

It has for a long time been a great need to be able to manufacture a decorative thermosetting laminate with a decor pattern with a surface structure as life like as the decor reproduced.

SUMMARY OF THE INVENTION

According to the present invention the above mentioned needs have been met and a decorative board with a decorative surface with a matching decor that overlaps the joints of adjacent boards has been achieved. The invention relates to a process for the manufacturing of panels having a decorative surface. The decor of the panels is achieved by means of printing a plurality of different decor sections on a web, each decor section being intended to constitute the decor of a panel, each decor further having a beginning and an end. The invention is characterised in that at least the end of a first decor section is made to match the beginning of a second decor section so that when the first decor section and the second decor section is arranged in a row, the decor of the first section will give the impression of continuing on the second decor section.

It is advantageous to provide the decorative surface with a pattern in predetermined fixed positions on at least the first and the second edges. The first edge pattern positions and the second edge pattern positions are then matched so that the pattern continues over the first and second edges of adjacent panels. As discussed earlier there are problems with change in format of the decor due to the treatment the decor is subjected to. This may cause problems with the intended matching. This may be overcome by arranging the predetermined fixed positions so that it extends over a matching tolerance distance. How to achieve this is further described in connection to enclosed figures.

The matching tolerance distance is in preferred embodiment suitably in the range 1-20 mm. It might however be possible to use a matching tolerance distance in the range 1-10 mm or even in the range 1-5 mm, much depending on well controlled the format changes of the decor is.

The plurality of decor sections are suitably arranged parallel to each other on the web. According to one embodiment of the invention the first decor section matches the beginning of the second decor section, an end of the second decor section matching a beginning of a third decor section and so on. An end of a final decor section then matches a beginning of the first decor section. This implies that the impression of an infinite wood plank can be achieved. However, as discussed earlier in the present invention the decor is most often achieved by means of a printing cylinder having a circumference corresponding to the length of a panel+machining tolerances this will mean an effective decor length of 1.2 m for each decor section. It is common to have 6 such decor sections arranged next to each other on the printing cylinder. If the end of the first decor section is designed to match the beginning of the second decor section, the end of the second matches the beginning of the third and so on, until the sixth and last section having an end matching the beginning of the first decor section, an effective length of an assembled row of panels may have a length of 7.2 meter in the given example without any repetition of the decor pattern. It is of course also possible to have two or three different sets of such matching resulting in two different sets with each a length of 3.6 meter or three different sets with each a length of 2.4 meter without any repetition in the decor.

It is also advantageous to provide the panels with a surface structure which matches and is in register with the decor. This may be achieved by any known means of surface structuring or embossing. The surface grades used for achieving the structure pattern may be selected from the group consisting of; groups of small oblong indentations, different grades of gloss to flat surface finish, ridges and recesses and combinations thereof.

The panels achieved through means of the present invention is suitably provided with identification means so that it will be easy for the installer to arrange the panels in the desired sequence. It is also possible to pack the panels so that they are stacked in sequence.

The panel may according to certain embodiment of the invention be constituted by a base layer, the decor layer as described above and a wear layer.

BRIEF DESCRIPTION OF THE DRAWINGS

The invention is further explained in connection to the accompanying drawings showing different embodiments of the invention where.

DETAILED DESCRIPTION OF THE EMBODIMENT EXAMPLES

Figure 1:
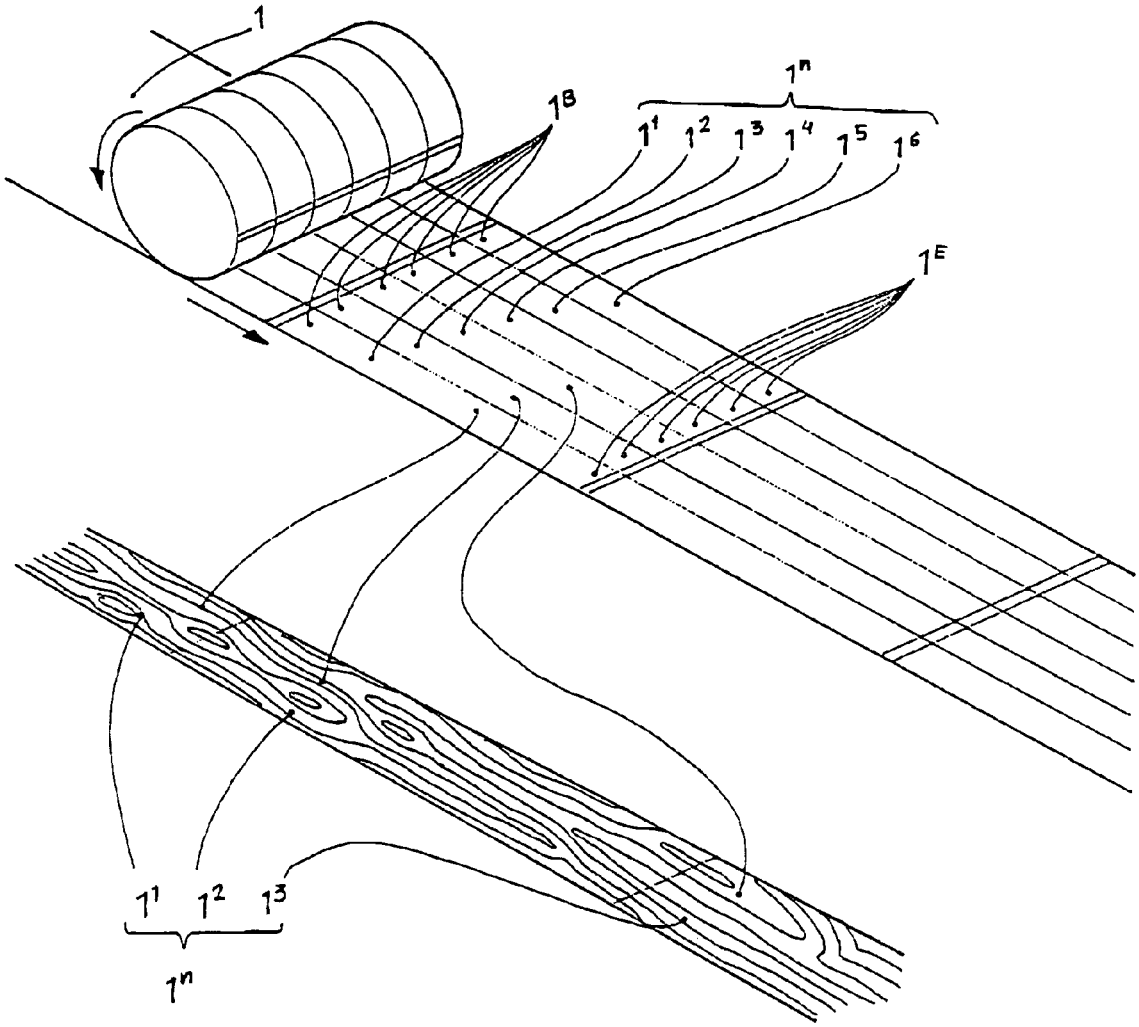
FIG. 1 shows schematically decor sections $\mathbf{1}^n$ of a decor web 1 according to an embodiment of the invention.

Accordingly, FIG. 1 schematically shows decor sections $\mathbf{1}^n$ of a decor web 1 intended to be used when manufacturing panels having a decorative surface. The decor of the panels is achieved by means of printing a plurality of different decor sections $\mathbf{1}^n$ in the form of a first to a sixth decor section $\mathbf{1}^1$, $\mathbf{1}^2$, $\mathbf{1}^3$, $\mathbf{1}^4$, $\mathbf{1}^5$ and $\mathbf{1}^6$ on a web 1. Each of the decor sections $\mathbf{1}^1$, $\mathbf{1}^2$, $\mathbf{1}^3$, $\mathbf{1}^4$, $\mathbf{1}^5$ and $\mathbf{1}^6$ are intended to constitute the decor of a panel. Each of the decor sections $\mathbf{1}^1$, $\mathbf{1}^2$, $\mathbf{1}^3$, $\mathbf{1}^4$, $\mathbf{1}^5$ and $\mathbf{1}^6$ is having a beginning $\mathbf{1}^B$ and an end $\mathbf{1}^E$. The end $\mathbf{1}^E$ of the first decor section $\mathbf{1}^1$ is made to match the beginning $\mathbf{1}^B$ of the second decor section $\mathbf{1}^2$ so that when the first decor section $\mathbf{1}^1$ and the second decor section $\mathbf{1}^2$ is arranged in a row, the decor of the first decor section $\mathbf{1}^1$ will give the impression of continuing on the second decor section $\mathbf{1}^2$. The beginning $\mathbf{1}^B$ and end $\mathbf{1}^E$ of the decor sections $\mathbf{1}^2$, $\mathbf{1}^3$, $\mathbf{1}^4$, $\mathbf{1}^5$ and $\mathbf{1}^6$ that follows are suitably also arranged to match as described above. Finally the end $\mathbf{1}^E$ of the sixth and last decor section $\mathbf{1}^6$ is suitably made to match the beginning $\mathbf{1}^B$ of the first decor section $\mathbf{1}^1$.

Figure 2:
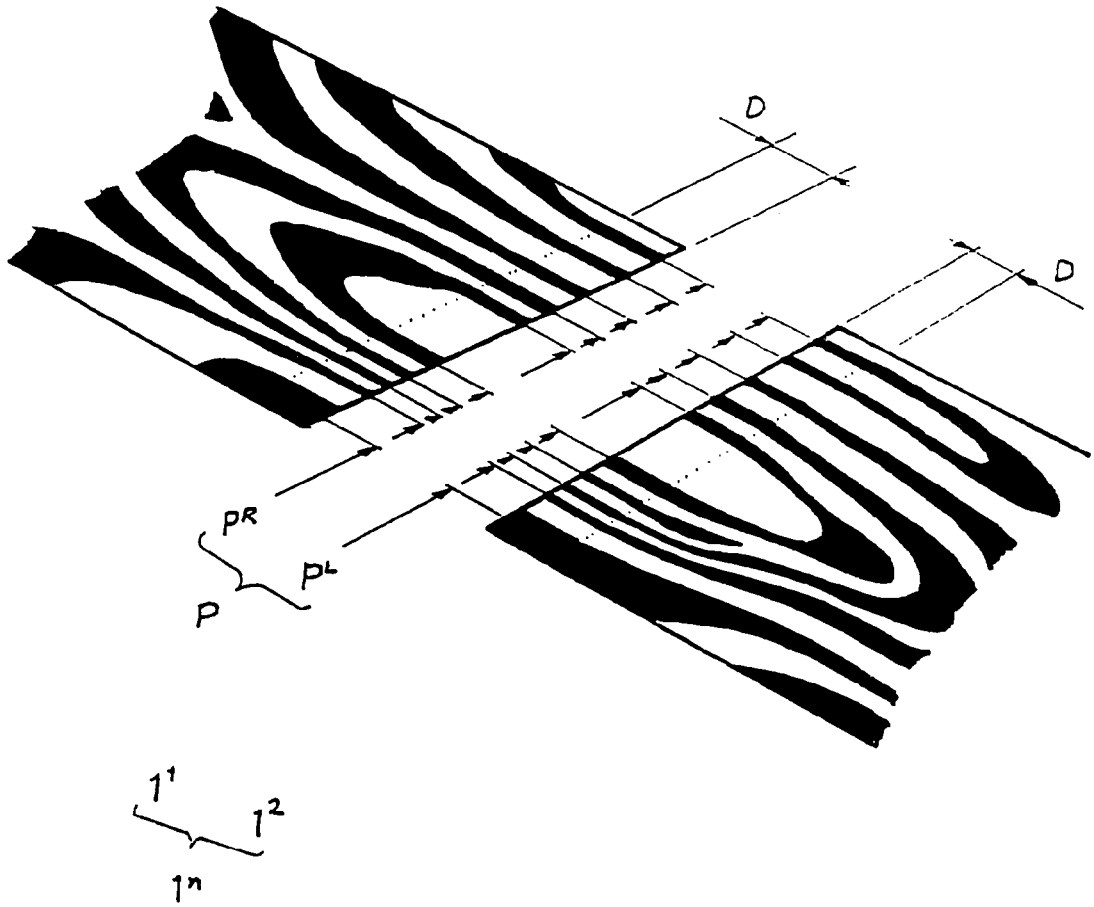
FIG. 2. shows schematically end parts $\mathbf{1}^E$ and $\mathbf{1}^B$ of two decor sections $\mathbf{1}^n$ according to an embodiment of the invention.

FIG. 2 show schematically the beginning $\mathbf{1}^B$ part of a second decor section $\mathbf{1}^2$ and the, matching, end $\mathbf{1}^E$ part of a first decor section $\mathbf{1}^1$ before they are cut into panels. The decorative surface is patterned in predetermined fixed positions P on the end $\mathbf{1}^E$ and the beginning $\mathbf{1}^B$. A first edge pattern positions $p^L$ and a second edge pattern positions $P^R$ are matched so that the pattern continues over the edges of adjacent panels. The predetermined fixed positions P extends over a matching tolerance distance D. A majority of this matching tolerance distance D is cut away when the panels are provided with edges.

The invention is not limited by the shown embodiments since they can be varied in different ways within the scope of the invention. It is for example possible to provide panels with a surface structure that matches the decor described. It is also to stimulate the structure of other materials and match them in a way as described above. such pattern may be fabric, minerals like polished marble or even completely fantasy based patterns. it is further possible to make other combinations of panels intended to have matching decor when joined together as for example having two panels not intended for such matching while the rest are Also other amounts of different decor sections than the six discussed in embodiments of the the present invention is of course possible to make.

What is claimed is:

1. A process for the manufacturing of panels having a decorative surface comprising printing on the decor of the panels with a printing cylinder, a plurality of different decor sections ($\mathbf{1}^n$) on a web (1), each decor section ($\mathbf{1}^n$) being intended to constitute the decor of a panel, each decor section ($\mathbf{1}^n$) having a beginning ($\mathbf{1}^B$) and an end ($\mathbf{1}^E$) wherein at least the end ($\mathbf{1}^E$) of a first decor section ($\mathbf{1}^1$) is made to match the beginning ($\mathbf{1}^B$) of a second decor section ($\mathbf{1}^2$) so that when the first decor section ($\mathbf{1}^1$) and the second decor section ($\mathbf{1}^2$) is arranged in a row, the decor of the first decor section ($\mathbf{1}^1$) will give the impression of continuing on the second decor section ($\mathbf{1}^2$), wherein predetermined fixed positions (P) extend over a matching tolerance distance (D) and the printing cylinder having a circumference corresponding to the sum of the lengths of the panels plus a matching tolerance distance.

2. A process according to claim 1, wherein the decorative surface is patterned in predetermined fixed positions (P) on the beginning ($\mathbf{1}^B$) and end ($\mathbf{1}^E$) of each decor section ($\mathbf{1}^n$), that the first edge pattern positions ($P^L$) and the second edge pattern positions ($P^R$) are matched so that the pattern continues over the first and second edges of adjacent panels.

3. A process according to claim 1, wherein the matching tolerance distance (D) is in the range 1-20 mm.

4. A process according to claim 1, wherein the matching tolerance distance (D) is in the range 1-10 mm.

5. A process according to claim 1, wherein the matching tolerance distance (D) is in the range 1-5 mm.

6. A process according to claim 1, wherein the plurality of decor sections ($\mathbf{1}^n$) are arranged parallel to each other on the web (1).

7. A process according to claim 1, further comprising sections comprise a surface structure which matches the decor described.

8. A process according to claim 1, further comprising imparting at least one of a gloss finish and a flat finish to the decor sections.

9. A process according to claim 8, wherein the imparted finish is a gloss finish.

10. A process according to claim 1, further comprising cutting the web into the panels at the matching tolerance distances, wherein a majority of the matching tolerance distances are cut away.

11. A process according to claim 10, further comprising imparting the panels with identifications so as to provide a sequence for installation.

12. A process according to claim 10, further comprising packing the panels to provide a sequence for installation.

13. A process according to claim 10, further comprising joining the divided panels to form a decor having a length of between 2.4 m and 7.2 m without repetition.

* * * * *